US006488800B1

(12) United States Patent
Pankoke

(10) Patent No.: US 6,488,800 B1
(45) Date of Patent: Dec. 3, 2002

(54) METHOD FOR CHANGING PULLING OFF A COVER WEB OF A PRODUCTION ROLL TO A STORING ROLL

(75) Inventor: Werner Pankoke, Bielefeld (DE)

(73) Assignee: Firma Theodor Hynmen, Bielefeld (DE)

( * ) Notice: Subject to any disclaimer, the term of this patent is extended or adjusted under 35 U.S.C. 154(b) by 0 days.

(21) Appl. No.: 09/564,584

(22) Filed: May 5, 2000

(30) Foreign Application Priority Data

May 7, 1999 (DE) ..... 199 21 041

(51) Int. Cl.[7] ..... B31F 5/00; B32B 31/08

(52) U.S. Cl. ..... 156/159; 156/165; 156/164; 156/157; 156/507

(58) Field of Search ..... 156/157, 159, 156/502, 504, 505, 507, 543, 494, 164, 165; 242/551, 553, 554, 554.1, 554.2, 555, 555.1, 555.2, 555.3, 555.4, 555.5, 555.6

(56) References Cited

U.S. PATENT DOCUMENTS 1,504,218 A * 8/1924 Crowell ..... 156/208
5,053,177 A 10/1991 Vetter et al.
5,437,749 A * 8/1995 Pipkorn ..... 155/64
5,534,105 A * 7/1996 Boyd ..... 156/324
5,575,873 A * 11/1996 Pieper et al. ..... 156/153

FOREIGN PATENT DOCUMENTS

| | | |
|---|---|---|
| EP | 369477 A | 5/1990 |
| ES | 2045203 T3 | 1/1994 |
| GB | 2047126 A | 11/1980 |
| GB | 1600543 A | 10/1981 |
| GB | 2078136 A | 6/1982 |

OTHER PUBLICATIONS

Search Report (Spanish Patent Office) of Jan. 24, 2002 for Application No. 200001750, Patent ES 2 164 607.

* cited by examiner

*Primary Examiner*—Richard Crispino
*Assistant Examiner*—George R. Koch, III
(74) *Attorney, Agent, or Firm*—Barnes & Thornburg

(57) ABSTRACT

In a lamination process, a method for changing the withdrawal of a top layer to be applied to a base material at a belt type press by feeding of the forward end of the top layer from a second roller to the rearward end of the top layer from a first roller. The top layer from the first roller is then cut off in coordination with the arrival of the forward end of the top layer arriving from the second roller, so that the ends of both top layers are positioned on the base material flush with one another with a slight separating line or in an overlapping manner.

20 Claims, 2 Drawing Sheets

METHOD FOR CHANGING PULLING OFF A COVER WEB OF A PRODUCTION ROLL TO A STORING ROLL

BACKGROUND AND SUMMARY OF THE INVENTION

The invention relates to a method in a lamination process for changing the withdrawal of a top layer width from a first moving roller (production roller) to a second roller (supply roller) in the continuous operation when manufacturing a layered material consisting of at least one top layer width and at least one base material width or during the coating of individual carrier plates with one or several top layer widths which are pressed together in heat and under pressure in a belt-type press.

It is an object of the invention to design a method of the above-mentioned type such that, in the continuous operation, a change from a production roller with a moving top layer width to the top layer width of a supply roller can take place fully automatically or semi-automatically, and that, independently of the assignment of the production roller and of the supply roller to the belt-type press, the steering of the forward end of the top layer width of the supply roller to the rearward end of the top layer width of the previous production roller can take place up to an overlapping or to a small separating line.

According to the invention, this object is achieved in that the moving top layer width, in coordination with the arrival of the forward end of the top layer width arriving from the second roller (supply roller), is cut off such that the end of the first and the start of the second top layer width are positioned on the base material flush with respect to one another with a small separating line or in an overlapping manner.

As the result of the precise steering of the forward end of the top layer width of the supply roller to the cut-off rearward end of the top layer width of the production roller, which is carried out by means of a computer, no waste will occur in the connection area between the top layer widths when passing through the active zone of the belt-type press, which is preferably constructed as a double-belt-type press, so that the working pressure in the double-belt-type press when passing through the connection area of the top layer widths does not have to be reduced.

According to the invention, the top layer can be tacked to the base layer by any of static friction, electrostatic attaching, adhesion, welding or a glued connection prior to feeding to the belt-type press.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
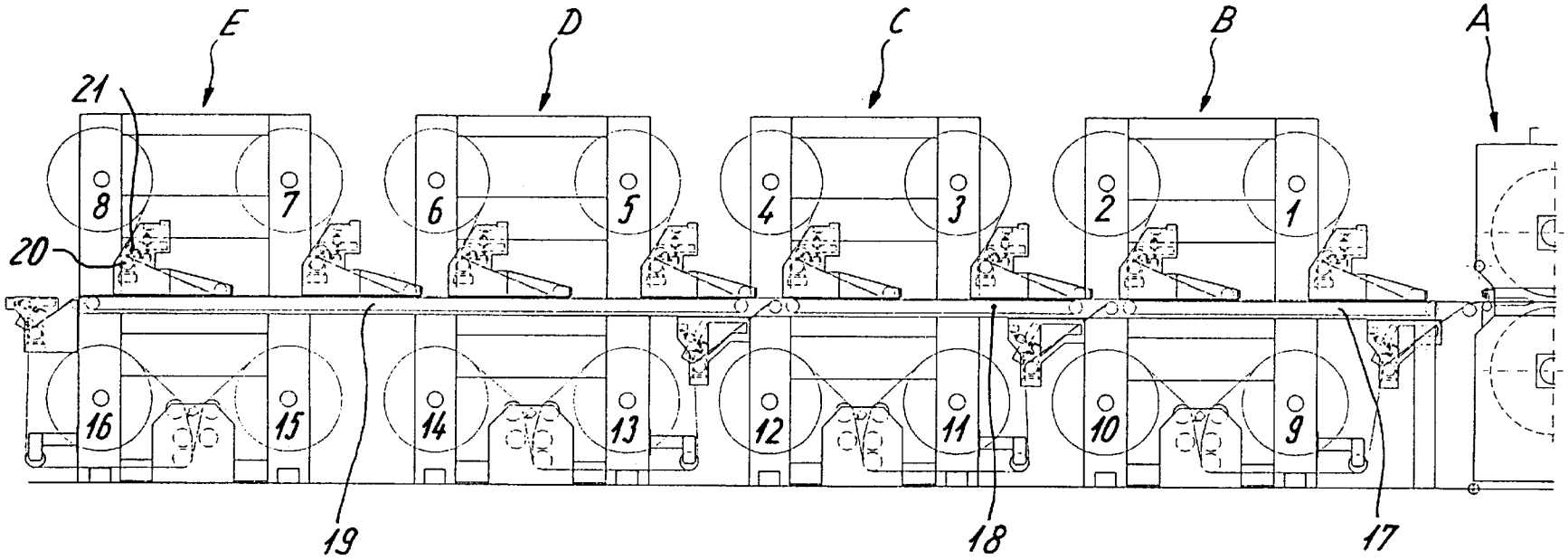
FIG. 1 is a vertical section of a series of unwinding stations assigned to a double-belt-type press.
Figure 2:
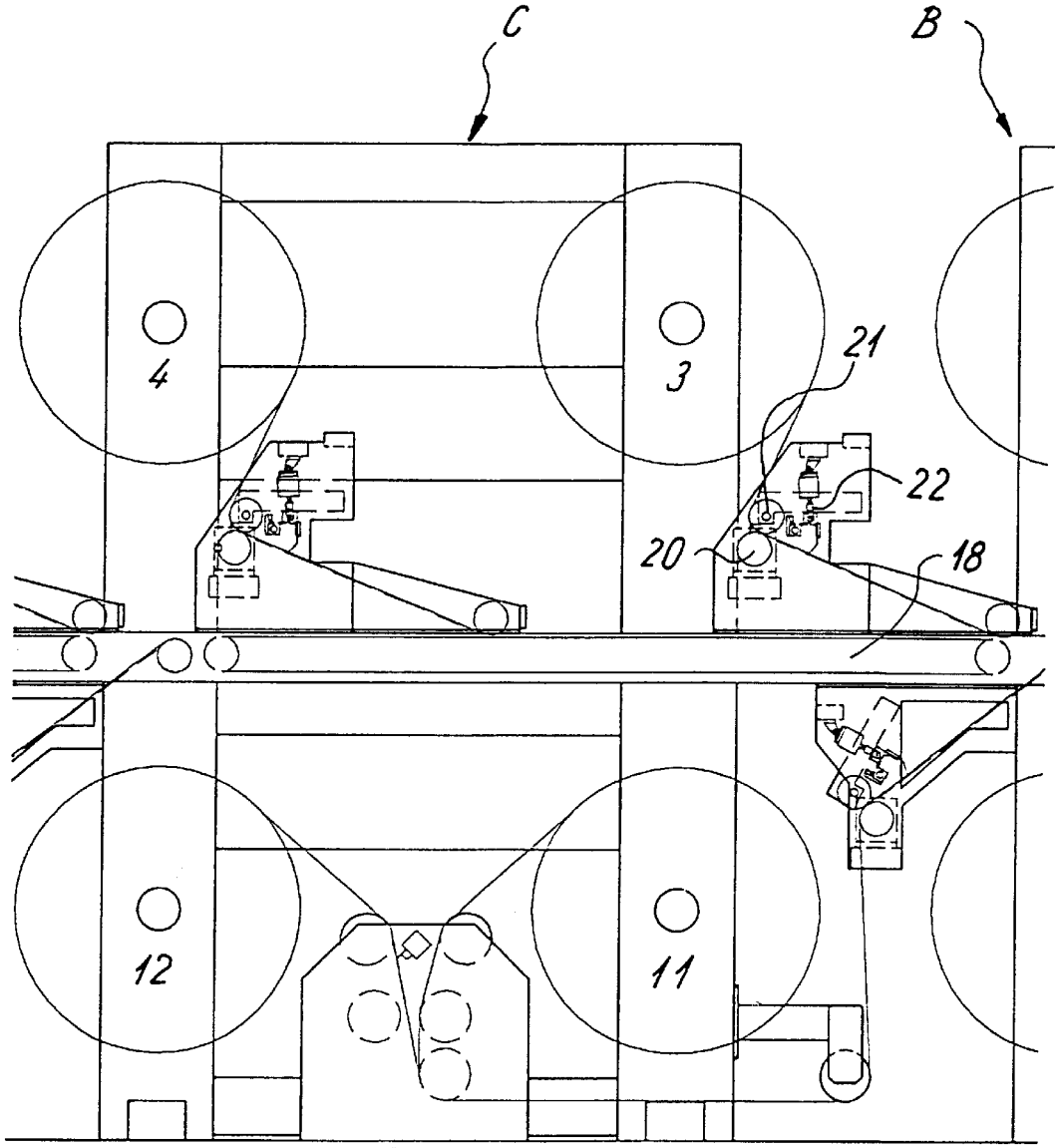
FIG. 2 is a partial enlargement from FIG. 1.

In the illustrated system, four unwinding stations B, C, D and E are assigned to a double-belt-type press A. Each unwinding station has two rollers for top layer widths and two rollers for base material widths.

The reference numbers 1, 2, 3, 4, 6, 7 and 8 are assigned to the roller provided with top layer widths, and reference numbers 9, 10, 11, 12, 13, 14, 15 and 16 are assigned to the rollers provided with base material widths.

Between the rollers 1 to 8 of the top layer widths and the rollers 9 to 16 of the base material widths, driven conveyer belts 17, 18 and 19 are arranged, which transport the base material widths and the top layer widths withdrawn from the rollers to the double-belt-type press A.

If the roller 3 represents the production roller and a change is to take place to the top layer width of the roller 8, the forward end of the top layer width of the roller 8 is first situated in a straight cut manner between driving rollers 20, 21 in front of a light barrier in a waiting position.

During the start for the change of the withdrawal from the roller 3 to the roller 8, the forward end of the top layer width withdrawn from the roller 8 travels along a distance computed by means of a computer and, after passing through this distance, triggers the top layer width separation of the top layer width moving off the roller 3. The top layer width, which is moving off the roller 3, is therefore cut off by means of a cutting device 22.

A separating line between the two top layer width ends can also be situated in these areas.

An electrostatic charging of the top layer width withdrawn from the roller 8 and approaching the production roller 3 causes an optimal flatness on the base material width moving on the bottom which is withdrawn from one or several of the rollers 9 to 16. As the result, a transport of the top layer width from the roller 8 is achieved which is free of disturbances.

The fixing of the top layer width approaching from the supply roller on the base material width can also take place by static friction, sealing, welding together or gluing together.

In the case of an optimal adjustment, well wound rollers and top layer widths without damage, the forward end of the supply roller and the rearward end of the previous production roller moves with an overlap into the double-belt-type press A, which may be in the range of from 0 to 50 mm, preferably in the range of from 0 to 10 mm.

In the case of a semi-automatic method of operation, the change from the previous production roller to a supply roller is initiated by pressure of a button by the system operator.

In the case of a fully automatic method of operation, the desired working lengths are stored and/or a scanning takes place of markings produced on the top layer widths, and a storage takes place of the positions of the various supply rollers provided with top layer widths.

If the roller 8 provided with a top layer width forms the production roller and a change to the top layer width of roller 5 is to take place, the top layer width of the roller 8 is cut off during the start of the change. After the separation, the rearward end of the top layer width moves along a computed distance and then, after passing through this distance, triggers the start of the roller 5.

Also in the case of this method of operation, the desired positioning of the two ends of the top layer widths takes place on the base material width which, together with the top layer width, will then move into the double-belt-type press A.

A cutting device 22 is additionally to the driving roller pair 20, 21 assigned to each roller 1 to 8 provided with top layer widths.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. In a lamination process, a method for changing the withdrawal of a top layer from a first roller to a second roller in a continuous operation whether the second roller is between the first roller and a belt press or the first roller is between the second roller and the press, when manufacturing a layered material consisting of at least one top layer and at least one base material which are pressed together under heat and pressure in the belt press, comprising:

a) when a first roller is between a second roller and the press, unwinding a first top layer from the first roller and placing the first top layer on a base material to form a double layer and forwarding the double layer along a path to the belt press, unwinding a second top layer having a forward end from a second roller and placing the second top layer on the base material so it will move to the path of the first top layer and base material moving to the press, then cutting the first top layer from the first roller such that the ends of the first and second top layers are positioned on the base material flush with respect to one another with either a small separating line or in an overlapping manner;

b) when the second moving roller is between the first roller and the press, unwinding a first top layer from the first roller and placing the first top layer on a base material to form a double layer and forwarding the double layer along a path to the belt press, cutting the first top layer from the first roller, then unwinding a second top layer having a forward end from a second roller and placing the second top layer on the base material such that the ends of the first and second top layers are positioned on the base material flush with respect to one another with either a small separating line or in an overlapping manner.

2. Method according to claim 1, when a first roller is between a second roller and the press, the forward end of the second top layer is withdrawn from the second roller by a pair of driving rollers and, after the second top layer travels along a computed distance, the first top layer moving off the first roller is cut off.

3. Method according to claim 2, wherein the ends of the top layers are introduced with an overlap to a double-belt press.

4. Method according to claim 3, wherein the forward end of the top layer arriving from a roller is fixed on the base material prior to entry into the belt press by any one of static friction, electrostatically attracting, adhesion, welding and glued connection.

5. Method according to claim 2, wherein the forward end of the top layer arriving from a roller is fixed on the base material prior to entry into the belt press by any one of static friction, electrostatically attracting, adhesion, welding and glued connection.

6. Method according to claim 2, wherein the ends of the top layers are introduced with a spacing therebetween of 0 and 50 mm.

7. Method according to claim 1, when the second roller is between the first roller and the press, the rearward end of the first top layer travels along a computed distance and then the second roller of the second top layer is started.

8. Method according to claim 7, wherein the ends of the top layers are introduced with an overlap to a double-belt press.

9. Method according to claim 8, wherein the forward end of the top layer arriving from a roller is fixed on the base material prior to entry into the belt press by any one of static friction, electrostatically attracting, adhesion, welding and glued connection.

10. Method according to claim 7, wherein the forward end of the top layer arriving from a roller is fixed on the base material prior to entry into the belt press by any one of static friction, electrostatically attracting, adhesion, welding and glued connection.

11. Method according to claim 7, wherein the ends of the top layers are introduced with a spacing therebetween of 0 and 50 mm.

12. Method according to claim 1, wherein the ends of the top layers are introduced with an overlap to the belt press and further comprising the step of providing the belt press as a double-belt press.

13. Method according to claim 12, wherein the forward end of the top layer arriving from a roller is fixed on the base material prior to entry into the belt press by any one of static friction, electrostatically attracting, adhesion, welding and glued connection.

14. Method according to claim 12, wherein the ends of the top layers are introduced with an overlap of between 0 and 50 mm.

15. Method according to claim 1, wherein the forward end of the top layer arriving from a roller is fixed on the base material prior to entry into the belt press by any one of static friction, electrostatically attracting, adhesion, welding and glued connection.

16. Method according to claim 1, wherein a top layer change is automatically initiated when a system operator pushes a button.

17. Method according to claim 1, wherein a top layer change is carried out automatically in response to a length of material on the top layer supply rollers.

18. Method according to claim 1, including providing a cutting device for the first moving roller and a cutting device for the second moving roller.

19. Method according to claim 1, wherein the ends of the top layers are introduced with a spacing therebetween of 0 and 50 mm.

20. Method according to claim 1, wherein the ends of the top layers are introduced with a spacing therebetween of 0 and 10 mm.

* * * * *